United States Patent [19]

Friedrich

[11] Patent Number: 4,535,021

[45] Date of Patent: Aug. 13, 1985

[54] BACKING MAT FOR A GROUND COVERING, PREFERABLY FOR A WATER-PERMEABLE ARTIFICIAL GRASS, AS WELL AS A METHOD FOR ITS PRODUCTION

[75] Inventor: Hans-Joachim Friedrich, Auenwald, Fed. Rep. of Germany

[73] Assignee: J. F. Adolff AG, Fed. Rep. of Germany

[21] Appl. No.: 587,242

[22] Filed: Mar. 7, 1984

[30] Foreign Application Priority Data

Mar. 24, 1983 [DE] Fed. Rep. of Germany ..... 3310640

[51] Int. Cl.[3] ..... A01N 3/00; A41G 1/00

[52] U.S. Cl. ..... 428/137; 428/17; 428/95; 428/253; 428/254; 428/262; 427/356; 427/358; 427/389.9; 427/394

[58] Field of Search ..... 428/17, 95, 137, 253, 428/254, 262; 427/356, 358, 389.9, 394

[56] References Cited

U.S. PATENT DOCUMENTS 4,007,307 2/1977 Friedrich ..... 428/95

*Primary Examiner*—Marion E. McCamish

*Attorney, Agent, or Firm*—Shenier & O'Connor

[57] ABSTRACT

A backing mat for a water-permeable artificial grass having a grid-like structure consisting of elastically pliable foamed plastic sections and openings arranged therebetween. To improve the qualities of the artificial grass with regard to tread elasticity bulbous projections are formed of foamed plastic on the underside of the backing mat at the edges of the openings.

14 Claims, 6 Drawing Figures

Figure 1:
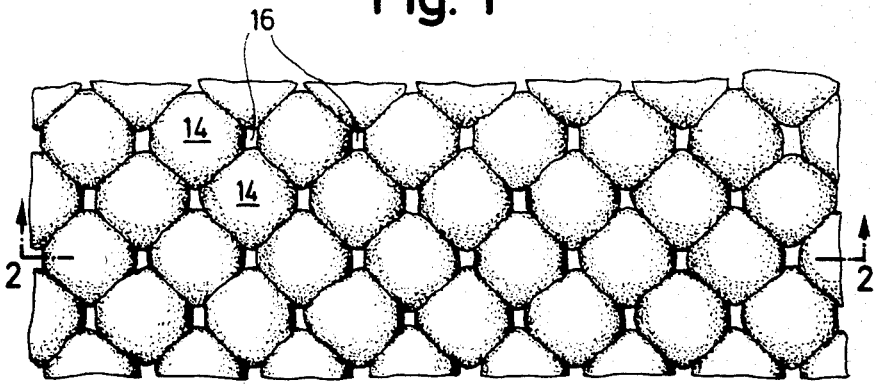

BACKING MAT FOR A GROUND COVERING, PREFERABLY FOR A WATER-PERMEABLE ARTIFICIAL GRASS, AS WELL AS A METHOD FOR ITS PRODUCTION

The invention relates to a backing mat for a ground covering, in particular for a water-permeable ground covering and preferably for a water-permeable artificial grass, comprising a grid-like structure of elastically pliable foamed plastic sections and openings arranged therebetween. It also relates to a method of producing backing mats of this type.

A known backing mat of this type for water-permeable artificial grass has a textile core made of a so-called raschel knitted material. This forms a checkered pattern consisting of approximately square sections formed by threads and being at least nearly closed and openings arranged therebetween which are also approximately square. This core is embedded in foamed plastic which forms cushion-like pads on the underside of the mat, between which the openings are arranged, whereas the textile core on the upper side of the mat is only slightly covered with foamed plastic.

This backing mat does have great advantages since water penetrating through the ground covering and backing mat may run off easily, i.e. to the sides, even when the ground covering and backing mat are laid on a plane, water-impermeable surface. This is brought about by the curvature of the cushion-like pads formed on the underside of the mat. However, the qualities of the known backing mats with regard to tread elasticity do leave something to be desired, especially when they form, together with an artificial grass, a playing field used by sportsmen. In order to achieve the desired cushioning effect for a foot treading on the surface of the pliable material to a ground covering having holes will need to be of a greater height than that for a ground covering without holes since the pliable material of the former, in this case the formed plastic, may yield into the openings. It would be possible to contemplate increasing the height of the cushion-like pads of the known backing mat described above by foaming the plastic to a greater degree. This will, however, reduce the modulus of elasticity of the foamed plastic so that nothing will be gained by this. It would also not be conceivable to apply a thicker layer of the formable plastic to the closed sections of the textile core of the known backing mat because the flowable plastic which is not yet foamed or its form stabilized would flow away through the openings in the textile core.

The object underlying the invention was to create a backing mat of the type described at the beginning which is superior to the known backing mat described above with a view to its qualities of tread elasticity. This object is accomplished according to the invention in that a backing mat of the type described at the beginning is designed such that it has bulbous projections on its underside at the edge of at least some of the openings, these projections being formed from foamed plastic and preferably not encircling the openings. Embodiments are preferred, with which projections having essentially the same form, i.e. the shape of a C when viewed from below, are associated with all the openings and are arranged in the same way around all the openings. In a preferred embodiment, the foamed plastic also forms cushion-like pads on the upper side of the mat, the openings being arranged between these pads.

The bulbous projections improve the qualities of tread elasticity; when they do not completely encircle the openings they also do not interfere with drainage of the water flowing down through the openings in the backing mat. Therefore, the backing mat may also be laid on a water-impermeable, plane ground surface. The bulbous projections on the underside of the inventive backing mat also have the effect that the forces exerted by a player landing on the ground, or the like, are partially diminished by fulling work so that the qualities of tread elasticity are not solely determined by the volume elasticity of the foamed plastic, as was the case with the known backing mat described above. The bulbous projections on the underside of the inventive backing mat also have the effect that a cavity having a relatively large volume will result between the backing mat and the ground surface so that, for example, a water-permeable artificial grass laid in the open will not become flooded so quickly even during heavy rainfall. The qualities of tread elasticity of a ground covering are also improved because the ground covering itself now lies on top of the cushion-like pads located on the upper side of the inventive backing mat and not on the thin foamed plastic layer which, in the case of the known backing mat, is found on the upper side of the textile core of the mat.

A particularly simple method of producing an inventive backing mat is characterized in that in a continuous procedure a foamable, flowable plastic is applied to the upper side of a web having openings in it and the thickness of the plastic coating is then adjusted, whereupon the plastic flowing downwards out of the openings is pressed at least partially upwards at the rear edges of the openings relative to the direction of feed and removed from the front edges of the openings relative to the direction of feed by at least one tool located beneath the web and that the plastic is formed and its form stabilized once the plastic which was pressed upwards has again passed downwards out of the openings.

The inventive backing mat is suitable for all ground coverings, for which special qualtities with regard to tread elasticity are required, irrespective of whether these are textile ground coverings or tile or web-like coverings made of plastic. The particular advantages of the inventive backing mat become most evident when it is used for a water-permeable artificial grass covering sports or playing fields.

Figure 2:
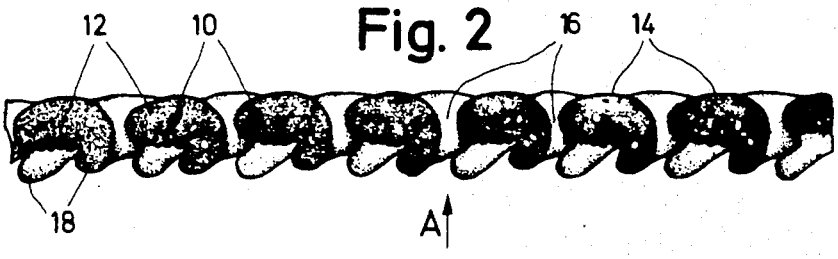
Figure 3:
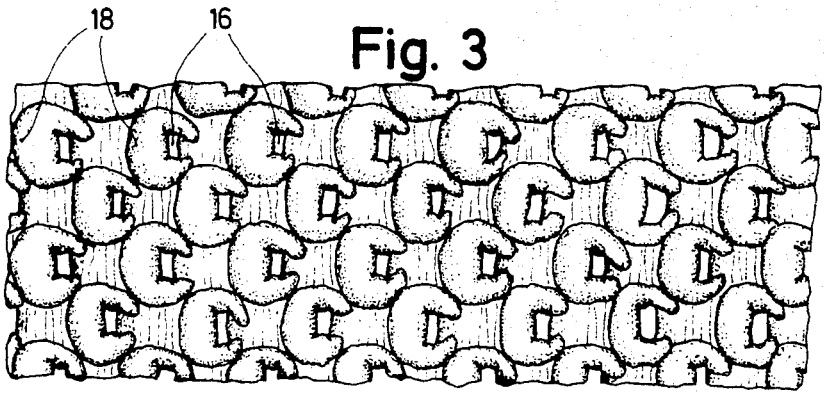
Figure 4:
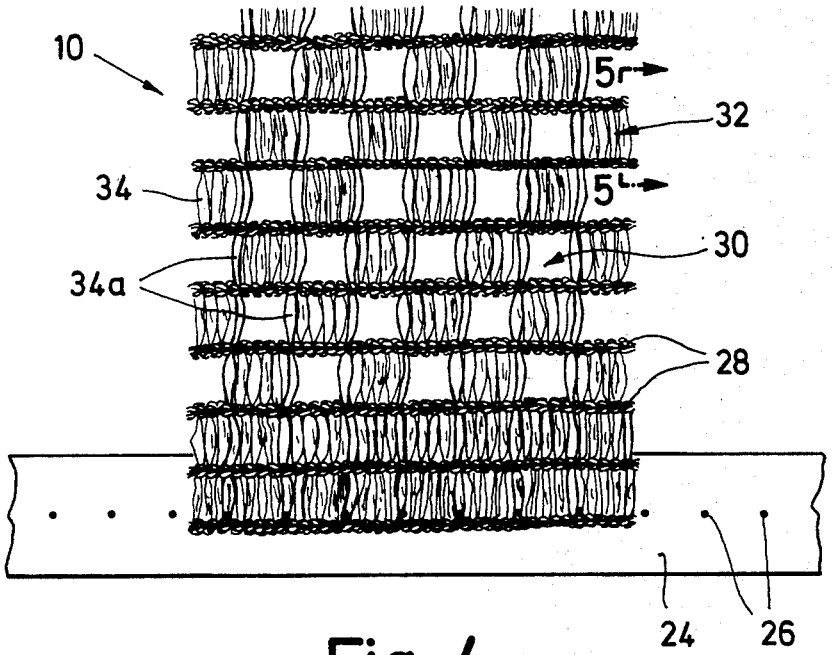
Figure 5:
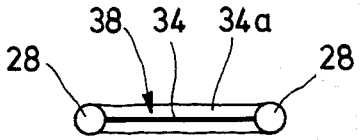
Figure 6:
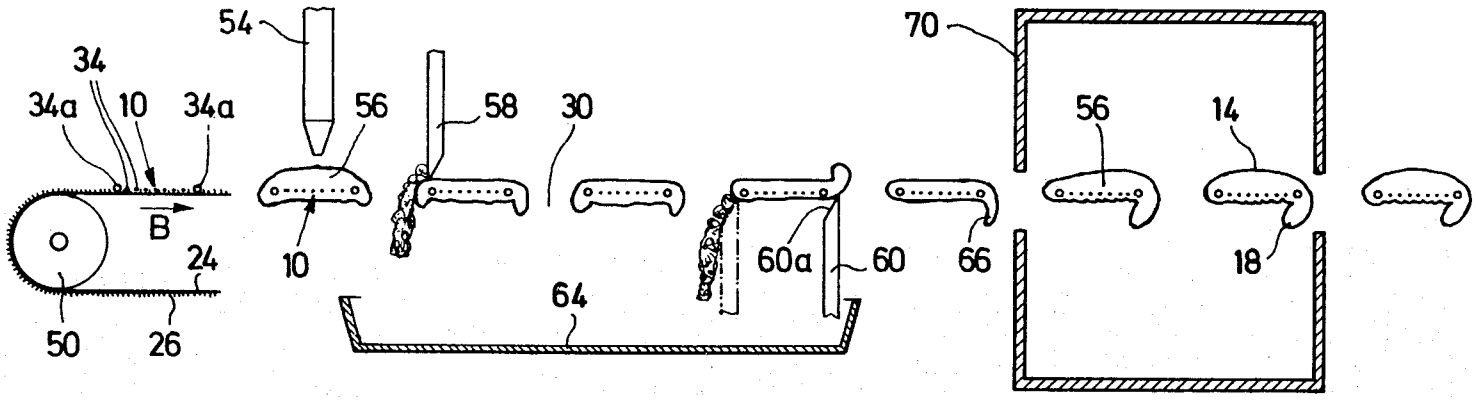

Additional features, advantages and details of the invention result from the attached claims and/or the following specification and attached drawings of a preferred embodiment of the inventive backing mat and a method for its production. The drawings show:

FIG. 1 a piece of the backing mat seen from above;

FIG. 2 a cross section along line 2—3 in FIG. 1;

FIG. 3 a view of the backing mat from below, seen in the direction of arrow A in FIG. 2;

FIG. 4 a piece of the textile core of the backing mat during production (see from above);

FIG. 5 a cross section along the line 5—5 in FIG. 4 through a section of the textile core and FIG. 6 a schematic illustration of the method of producing the backing mat.

The preferred embodiment of the inventive backing mat shown in FIGS. 1 to 3 comprises a textile core 10 (vide FIG. 2) in the form of a web-like raschel knitted material which will be described in more detail on the basis of FIGS. 4 and 5. This textile core is embedded in foamed plastic 12 which forms, on the upper side of the backing mat, a grid pattern of cushion-like pads 14, between which the drainage openings 16 are located. The domed shape of the pads 14 results in the advantage that water accumulating on the upper side of the backing mat may be drained off completely in the direction of the drainage openings 16.

The foamed plastic forms, on the underside of the backing mat, bulbous projections 18 which are shaped in the plan view approximately like a C and, according to the invention, flank the drainage openings 16 on three sides. According to FIG. 3 they each have their highest point to the left of the associated drainage opening. As shown in FIG. 2, the height of the projections 18, at their highest point, is greater than the width of the drainage openings. This will result in the tread elasticity qualities of the backing mat being particularly good. In the region of the arms of the C-shaped projections 18, which taper towards their free ends, the height of these projections is gradually reduced to zero. FIGS. 2 and 3 also show that the foamed plastic covers the underside of the textile core 10 only with a thin layer.

FIGS. 4 shows part of the equipment used for production of the inventive backing mat, namely part of an endless circulating conveyor belt 24 which is equipped with nails 26. The textile core 10, which forms a web, is held at its longitudinal edges by the nails 26 of two such conveyor belts 24 spaced transversely from each other and is moved in the longitudinal direction of the conveyor belts so that the inventive method may be carried out. As already mentioned, the textile core 10 consists preferably of a raschel knitted material having wales 28 extending in a longitudinal direction and between which openings 30 and closed sections 32 are arranged to form, according to the invention, a checkered pattern. The closed sections 32 are formed by threads, yarns or small strips 34 which are intermeshed with the wales 28, the threads 34*a* at the edge of and limiting the sections 32 relative to the openings 30 hereby being thicker than the remaining threads of the sections 32. This will result in the sections 32 having a certain trough-like shape. In FIG. 5, such a trough has been designated 38.

FIG. 6 shows only one of two carrier rollers 50, over which the two conveyor belts 24 run. As shown on the left-hand side of FIG. 6 the web formed by the textile core 10 is laid on top of the two conveyor belts 24 and held in place by means of the nails 26. The conveyor belts 24 are driven in the direction of arrow B in FIG. 6. At a first station, a foamable, flowable plastic 56 is applied to the upper side of the textile core 10 through a nozzle 54, the thickness of the plastic coating remaining on the closed sections 32 of the textile core 10 thereby being regulated by a doctor blade 58. At a third station, a doctor blade 60 serves to press, with its slanted edge 60*a*, at least part of the plastic 56 flowing downwards out of the openings 30 back up through each of the openings at their rear edges with respect to the direction of feed while, at the front edge of each opening, the plastic flowing downwards through these openings will be severed by the doctor blade 60, as shown more clearly in FIG. 6 by the doctor blade 60 indicated by a dash-dot line (the doctor blade is, of course, always positioned at the same spot, i.e. that indicated by solid lines). The thickness of the plastic layer on the underside of the textile core 10 is adjusted at the same time by the doctor blade 60. The plastic removed from the textile core is collected in a pan 64 and may be used again.

A plurality of doctor blades 60 may also be provided, one after the other, for the underside of the textile core 10.

Once the web has passed over the last doctor blade 60 the plastic which has been pushed upwards by the blade or blades will again flow downwards through each of the openings 30 at their rear edges to form a bead 66. Subsequently, the web will pass through an oven 70, in which the plastic is foamed and its form stabilized. The pads 14 and bulbous projections 18, which, as shown in FIG. 3, have the shape of a turned-up collar, will thereby be formed. Finally, the web is removed from the conveyor belts 24, for example by a lifting roller which is provided behind the last carrier roller 50 and over which the web runs.

I claim:

1. A backing mat for a ground covering such as artificial grass comprising a grid-like structure of elastically pliable formed plastic sections having openings arranged therebetween, characterized in the provision of bulbous projections on the underside of the mat, said projections being located at the edges of at least some of said openings and projecting downwardly beyond the material in the center regions of said sections between said openings, each of said projections being limited to less than the full periphery of the opening with which it is associated.

2. Mat as defined in claim 1, characterized in that projections having essentially the same design and arrangement are associated with all the openings.

3. Mat as defined in claim 2, characterized in that said projections—when viewed from below—are approximately shaped like a C and the thickness of their upper and lower arms is gradually reduced to zero towards their free ends.

4. Mat as defined in claim 1 characterized in that said projections—when viewed from below—are approximately shaped like a C and the thickness of their upper and lower arms is gradually reduced to zero towards their free ends.

5. Mat as defined in claim 1 characterized in that the foamed plastic forms on the upper side of said mat cushion-like pads, between which the openings are arranged.

6. Mat as defined in claim 5, characterized in that said pads and said openings form an approximately checkered pattern.

7. Mat as defined in claim 1 characterized in that it has a textile core which forms a checkered pattern consisting of approximately rectangular and preferably square sections which are formed by threads and which are at least nearly closed and openings arranged therebetween which are also approximately rectangular or square.

8. Mat as defined in claim 7, characterized in that the threads forming at least two opposite edges of said sections—perpendicular to the plane of said mat—have larger dimensions than the threads located in the inner part of said sections so that each section forms an upwardly open trough when viewed in a section perpendicular to said edge threads.

9. Mat as defined in claim 8, characterized in that the foamed plastic forms only a thin layer on the underside of said sections of said textile core, with the exception of said bulbous projections.

10. Mat as defined in claim 7, characterized in that the foamed plastic forms only a thin layer on the underside of said sections of said textile core, with the exception of said bulbous projections.

11. Mat as defined in claim 1 characterized in that the height of said projections at their highest point is at least approximately equal to the width of said projections and preferably greater than their width.

12. Mat as defined in claim 1 characterized in that said projections have the shape of a turned-up collar.

13. A method for producing a mat as defined in claim 1, characterized in that in a continuous procedure a foamable, flowable plastic is applied to the upper side of a web having openings in it and the thickness of the plastic coating is then adjusted, whereupon the plastic flowing downwards out of the openings is pressed at least partially upwards at the rear edges of said openings relative to the direction of feed and removed from the front edges of said openings relative to the direction of feed by at least one tool located beneath the web, and that the plastic is foamed and its form stabilized once the plastic which was pressed upwards has again passed downwards out of said openings.

14. Method as defined in claim 13, characterized in that the web is held and propelled at its lateral longitudinal edges.

* * * * *

UNITED STATES PATENT AND TRADEMARK OFFICE

CERTIFICATE OF CORRECTION

PATENT NO. : 4,535,021

DATED : August 13, 1985

INVENTOR(S) : Hans-Joachim Friedrich

It is certified that error appears in the above-identified patent and that said Letters Patent are hereby corrected as shown below:

Column 4, line 19, "formed"

should read -- foamed --.

Signed and Sealed this

*Twenty-second* Day of *October 1985*

[SEAL]

*Attest:*

DONALD J. QUIGG

*Attesting Officer*

*Commissioner of Patents and Trademarks—Designate*